US006168001B1

(12) United States Patent
Davis

(10) Patent No.: US 6,168,001 B1
(45) Date of Patent: Jan. 2, 2001

(54) POSITIVE DRIVE COIN DISCRIMINATION APPARATUS AND METHOD

(75) Inventor: David Lawrence Davis, Indianola, WA (US)

(73) Assignee: Coinstar, Inc., Bellvue, WA (US)

( * ) Notice: Under 35 U.S.C. 154(b), the term of this patent shall be extended for 0 days.

(21) Appl. No.: 08/883,655

(22) Filed: Jun. 27, 1997

(51) Int. Cl.[7] ..... G07D 5/08
(52) U.S. Cl. ..... 194/200; 194/317; 453/57
(58) Field of Search ..... 453/3, 4, 12, 32, 453/34, 49, 57; 194/200, 317, 318

(56) References Cited

U.S. PATENT DOCUMENTS

| | | | | |
|---|---|---|---|---|
| 1,234,707 | | 7/1917 | Whister | 453/8 X |
| 3,297,242 | | 1/1967 | Karp | 232/1 |
| 3,463,171 | | 8/1969 | Dolman . | |
| 3,599,771 | | 8/1971 | Hinterstocker | 194/318 |
| 3,680,566 | | 8/1972 | Tanaka et al. | 133/3 |
| 3,965,912 | | 6/1976 | Gross . | |
| 4,059,122 | * | 11/1977 | Kinoshita | 453/3 |
| 4,111,216 | | 9/1978 | Brisebarre . | |
| 4,148,331 | | 4/1979 | Nicolaus . | |
| 4,184,366 | | 1/1980 | Butler | 194/317 X |
| 4,398,550 | | 8/1983 | Shireman | 133/1 A |
| 4,471,864 | | 9/1984 | Marshall | 194/100 |
| 4,556,140 | * | 12/1985 | Okada | 194/206 |
| 4,574,824 | | 3/1986 | Paulsen et al. . | |
| 4,588,712 | | 5/1986 | Sentoku et al. | 133/3 R |
| 4,733,765 | | 3/1988 | Watanabe | 194/206 |
| 4,753,625 | * | 6/1988 | Okada | 453/32 |
| 4,754,862 | | 7/1988 | Rawicz-Szczerbo et al. | 194/317 X |
| 4,960,196 | | 10/1990 | Kanehara et al. | 194/215 |
| 4,978,322 | | 12/1990 | Paulsen | 453/57 |
| 5,098,339 | | 3/1992 | Dabrowski | 453/30 |
| 5,131,885 | | 7/1992 | Nakao et al. | 4532/11 |
| 5,167,571 | | 12/1992 | Waller | 453/29 |
| 5,254,032 | | 10/1993 | Abe | 453/56 |
| 5,279,404 | | 1/1994 | Bruner et al. | 194/346 |
| 5,285,883 | * | 2/1994 | LeHong et al. | 194/317 |
| 5,316,120 | | 5/1994 | Ibarrola | 194/318 |
| 5,326,312 | | 7/1994 | Patroni | 453/57 |
| 5,386,902 | | 2/1995 | Bointon et al. | 194/346 |
| 5,484,334 | | 1/1996 | Evdokimo | 453/3 |

FOREIGN PATENT DOCUMENTS

| | | | | |
|---|---|---|---|---|
| 0 209 357 | | 1/1987 | (EP) | G07D/9/04 |
| 209 357 | | 1/1987 | (EP) . | |
| 1255492 | * | 12/1971 | (GB) | 194/317 |
| 2 198 274 | | 6/1988 | (GB) | G07D/3/00 |
| 1-307891 | | 12/1989 | (JP) . | |
| 3-63795 | | 3/1991 | (JP) . | |

* cited by examiner

*Primary Examiner*—F. J. Bartuska
(74) *Attorney, Agent, or Firm*—Sheridan Ross P.C.

(57) ABSTRACT

A coin discrimination device which provides for positive transport of coins past a sensor is provided. In one embodiment, a rotating disk, slightly inclined to the vertical, includes a plurality of pockets for receiving coins from a hopper bowl. The disk and bowl are configured to efficiently load the pockets with no more than one coin per pocket. As the disk rotates, the coins, which are thus registered in a desired location in the pockets, are transported by the rotating disk past a sensor. When, based on the sensor data, the item in a pocket is recognized as an acceptable coin, a controllable ramp is lowered to divert the coin out of the pocket and into a path to place the coin in an acceptance bin or bag.

26 Claims, 12 Drawing Sheets

POSITIVE DRIVE COIN DISCRIMINATION APPARATUS AND METHOD

Cross reference is made to application Ser. No. 08/807,046 now abandoned which is a continuing application claiming priority based on application Ser. No. 08/672,639 filed Jun. 28, 1996, for Coin Sensing Apparatus and Method, which has been converted to a provisional application, incorporated herein by reference. Cross-reference is made to application Ser. No. 08/237,486 filed May 3, 1994, now U.S. Pat. No. 5,620,079 for Coin Counter/Sorter and Coupon/Voucher Dispensing Machine and Method, which is a continuation of Ser. No. 08/255,539 (now U.S. Pat. No. 5,564,546) filed Jun. 6, 1994, further cross-reference is made to application Ser. No. 08/431,070 filed Apr. 27, 1995 now U.S. Pat. No. 5,746,299 for Coin Counter Dejamming Method and Apparatus, and to Application Ser. No. PCT/US97/03136 filed Feb. 28, 1997, which claims priority in provisional Application Ser. No. 60/012,964 filed Mar. 7, 1996, for Method and Apparatus for Conditioning Coins Prior to Transport Sorting and Counting and, further, cross-reference is made to application Ser. No. 08/883,780, now U.S. Pat. No. 5,988,348 filed on even date herewith for Coin Sensing Apparatus and Method, all of which are commonly assigned herewith, and all of which are incorporated herein by reference.

BACKGROUND INFORMATION

A number of devices employ singulators, transport devices, sensors and/or diverters (STSD devices) for handling, identifying and/or discriminating coins or other small discrete objects. Examples include coin counting or handling devices, such as those described in U.S. patent application Ser. Nos. 08/255,539, 08/237,486, and 08/431,070, all of which are incorporated herein by reference. Other examples include vending machines, gaming devices such as slot machines, bus or subway coin or token "fare boxes," and the like.

Many previous coin STSD devices were configured for use in devices which receive only one coin at a time, such as a typical vending machine which receives a single coin at a time through a coin slot. These devices typically present an easier sensing environment because there is a lower expectation for coin throughput, an avoidance of the deposit of foreign material, an avoidance of small inter-coin spacing (or coin overlap), and because the slot naturally defines maximum coin diameter and thickness. STSD devices that might be operable for a one-at-a-time coin environment may not be satisfactory for an environment in which a mass or plurality of coins can be received all at once in a single location (such as a tray for receiving a mass of coins, poured into the tray from, e.g., a coin jar). Accordingly it would be useful to provide coin handling components, and, particularly STSD devices, that, (although they might be successfully employed in a one-coin-at-a-time environment), can function satisfactorily in a device which receives a mass of coins.

In many situations, the reliability and accuracy of the coin sorting, identification and counting processes is very important and thus the process of removing non-coin matter before the coins are transported to sorting, identification and/or counting sensors is important. In many previous devices, coins are either inserted into a machine singularly, or in the case of large commercial sorting machines, by trained personnel. It has been difficult to successfully provide devices for handling mass-input coins for use by the general public, i.e. persons without special training or skills (such as machines located in a retail location, for receiving a mass of coins from a shopper, and outputting a voucher, credit, electronic funds transfer, or the like, for an amount related to the value of the coins. This is at least partially because it has been found that such untrained users are likely to empty their personal containers, such as old cans or bottles, directly into the hopper without first inspecting the coins. Thus lint, tokens, liquids and various other objects will often accompany the coins into the machine. The presence of non-coin matter is believed to be especially troublesome in the context of self-service, stand-alone, unmonitored and/or unattended devices, e.g. devices for counting/sorting coins for use by the general public or other non-trained persons. Accordingly, it would be useful to provide self service coin processing machinery which can process coins, received in a mass, and which are accompanied by non-coin matter.

It is believed that, to be successful, such devices must have relatively low fabrication and maintenance costs. Many previous coin handling devices attempted to avoid certain costs by using gravitational forces, e.g. for transporting coins past one or more sensors. While gravity-feed maybe suitable for some applications or in some parts of a machine, this approach can be undesirably affected by coin condition and/or the presence of non-coin objects or materials (which are particularly common in self-service, untrained-user applications), and which may lead to jams and/or inaccuracies in coin discrimination or counting. Accordingly, it would be useful to provide a coin-handling device which has relatively low fabrication and maintenance costs, while reducing or eliminating inaccuracies or jamming.

SUMMARY OF THE INVENTION

The present invention provides a coin-handling device which, rather than being gravity-fed, provides positive positioning and/or transport of coins, e.g. past a sensor. In one embodiment a single hopper structure achieves singulation, transport, sensing and diversion, preferably all performed on or adjacent a single rotating disk. The disk defines one or more pockets which receive coins from a mass of coins in an adjacent bowl. The disk and, optionally, adjacent fingers and ledges, are configured to position, at most, one coin in each pocket, thus achieving singulation, as the disk rotates. Rotation of the disk carries the pockets past at least one sensor, thus achieving transport and sensing functions, without the need for relying on gravitational forces to achieve such transport and sensing. In this way, the position and velocity of a coin, as it moves past the sensor, is known (within a tolerance) which permits the coin counting/discrimination hardware or software to be less complex, and, typically, more accurate, compared to many gravity-fed systems.

In one embodiment, a ramp can be selectively lowered to divert coins (or other objects) from pockets, thus achieving the diversion function. Preferably the device is configured such that unrecognized objects remain in the pockets to travel past the diverter (and are preferably delivered to a reject or customer-return chute), while recognized, valued coins (or other objects) are removed from pockets as they rotate to the diverter. Such an active acceptance device is believed to result in increased accuracy (compared to, e.g., an approach in which unrecognized or unaccepted coins or other objects are diverted in order to separate them from accepted coins).

Accordingly, in one embodiment, the functions of singulation, transport, sensing and diversion occur adjacent a single disk, such as in or adjacent to a hopper device. The reduction in part-count and complexity that this approach permits is believed to contribute to lower fabrication and maintenance costs, while permitting construction of a device that has high accuracy, particularly for self-service, untrained-user, mass-input applications.

DETAILED DESCRIPTION OF THE PREFERRED EMBODIMENTS

Figure 1:
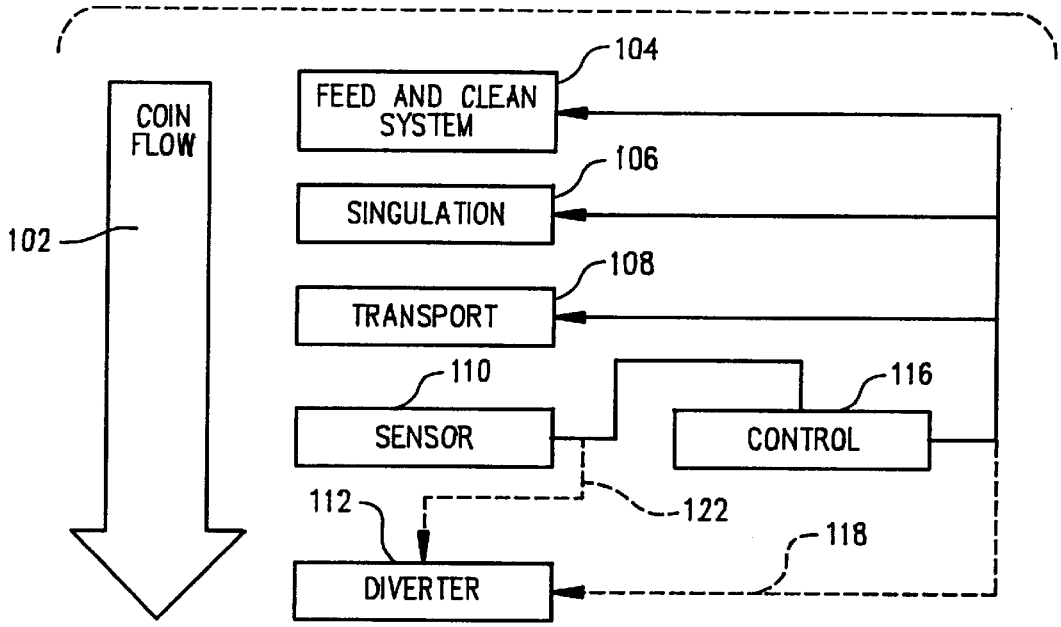
FIG. 1 is a block diagram of a coin discriminating device.

FIG. 1 depicts one manner of conceptualizing the stages or functions of a mass-input retail-level coin discriminating or counting device. Considering the functions generally in the order of the direction of coin flow 102, a feed and clean system 104 receives the mass of coins and preferably performs some form of cleaning to deal with non-coin objects, preferably feeding or moving the coins toward downstream components. A singulation component 106 receives coins and outputs one or more streams of coins in a singulated "one at a time" fashion. A transport mechanism 108 moves the coins, one at a time, past a sensor 110, which senses one or more characteristics of the coins or other objects. The sensor 110 may be configured to discriminate among different denominations of coins, discriminate coins of one country from those of another, and the like. The sensed characteristics, appropriately manipulated and/or combined with other sensed characteristics, are provided to diverter 112 for sending valued coins to one location and non-coin items to another location. In some configurations the diverter 112 may divert different denominations of coins to different locations. A control device 116, typically a programmable control device such as a computer, processor or hard-wired logic device, may provide control signals to various components such as by controlling the feed and clean system 104 to turn on and off (e.g., for regulating the flow of coins) and/or controlling the singulation system 106 to start, stop, or change speed. When the transport system 18 has active components (i.e., is other than a fully passive transport system such as a passive rail system), the control device 116 may provide control signals to the transport system, e.g., to initiate, stop or control the rate of transport. The diverter 112 may receive its control signals either from the control device 116 or, in some cases, directly from the sensor 110 or hardware associated therewith 122, bypassing the control unit 116.

One aspect of the present invention is directed principally to the singulation and transport functions 106, 108, and preferably provides a single rotating disk which both singulates coins (or other objects) and transports the singulated objects past a sensor 110. When considering the present invention in the context of FIG. 1, however, it should be noted that features or characteristics of one of the subsystems may affect the operation or selection of another system or function. For example, when a sensor system 110 is provided which has predetermined limits on how quickly the coin may move past the sensor, such constraints will have an impact on the design and/or control of the transport system 108. It should further be noted that systems shown as separate systems in FIG. 1 may be combined or may overlap. For example, in one aspect of the present invention, a single disk is used both for portions of the singulation function, the transport function and the diverter function. Furthermore, the fact that there may be some cleaning which occurs in the feed and clean system 104 is not incompatible with providing some cleaning function in other systems such as the singulation system and/or the diverter system.

In one embodiment, the feed and clean system 104 can include an input tray and/or slide similar to that described in U.S. Pat. No. 5,564,546 and/or a trommel or coin conditioning system similar to that described in Ser. No. PCT/US97/03136 and/or Ser. No. 60/012,964. In either case, in one embodiment a singulation system 106 receives a mass of (possibly partially cleaned) coins and/or other objects fed to it by the feed and clean system 104.

In one embodiment, depicted in FIGS. 2 through 7, the mass of coins is placed in a bowl 212 with an open side 214 adjacent a rotatably mounted disk 216. Preferably, the disk 216 is driven so as to rotate at about 60 to 72 RPM. Preferably, the level of coins in the bowl 212 and/or the rate at which coins are introduced into the bowl 212, is controlled either by upstream feed systems 104, or by physical walls or barriers. In one embodiment, openings (smaller than the smallest acceptable coin) adjacent the bottom of the bowl 212 permit small debris to fall into a preferably removable trap 352.

Figure 4:
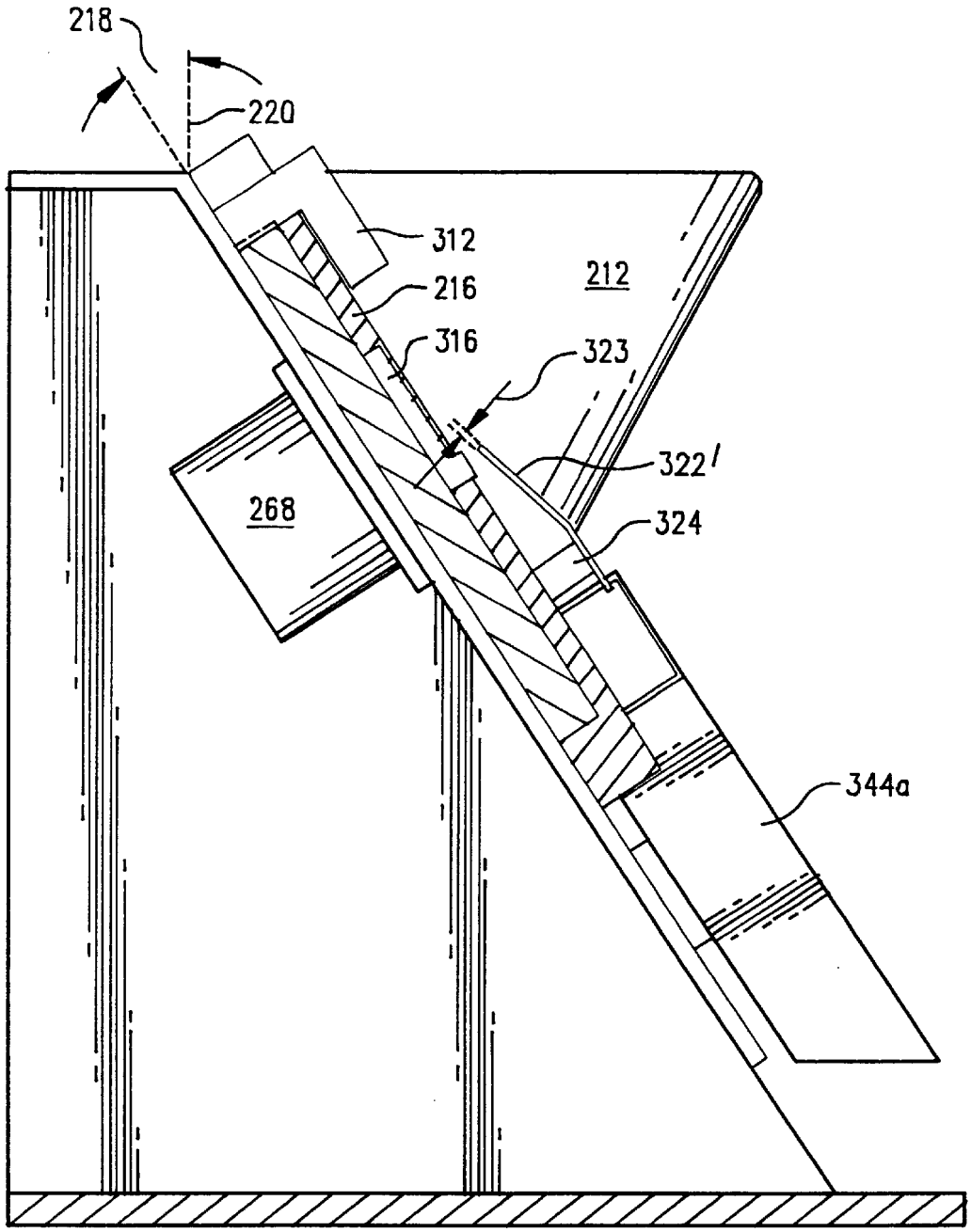
FIG. 4 is a side elevational view of the device of FIG. 2 partially in cross-section.

As seen in FIG. 4, the disk is mounted at an angle 218 to vertical 220, (equal to the angle of the axis of rotation from horizontal) preferably between about zero and 45 degrees (more preferably between about 10 degrees and about 15 degrees, and even more preferably about 15 degrees). Disk 216 is provided with one or more recessed areas or pockets 224*a* through 224*l*. In the depicted embodiment the pockets are U-shaped, and have a diameter 226 sufficient to accommodate, and preferably substantially equal to, the diameter of the largest coin which can be accepted. For example, in one embodiment, when the machine is configured to accept all common U.S. coins, the pockets will have a diameter 226 of about 1.1 inches (about 28 mm), in order to accommodate the U.S. fifty-cent piece.

Figure 3:
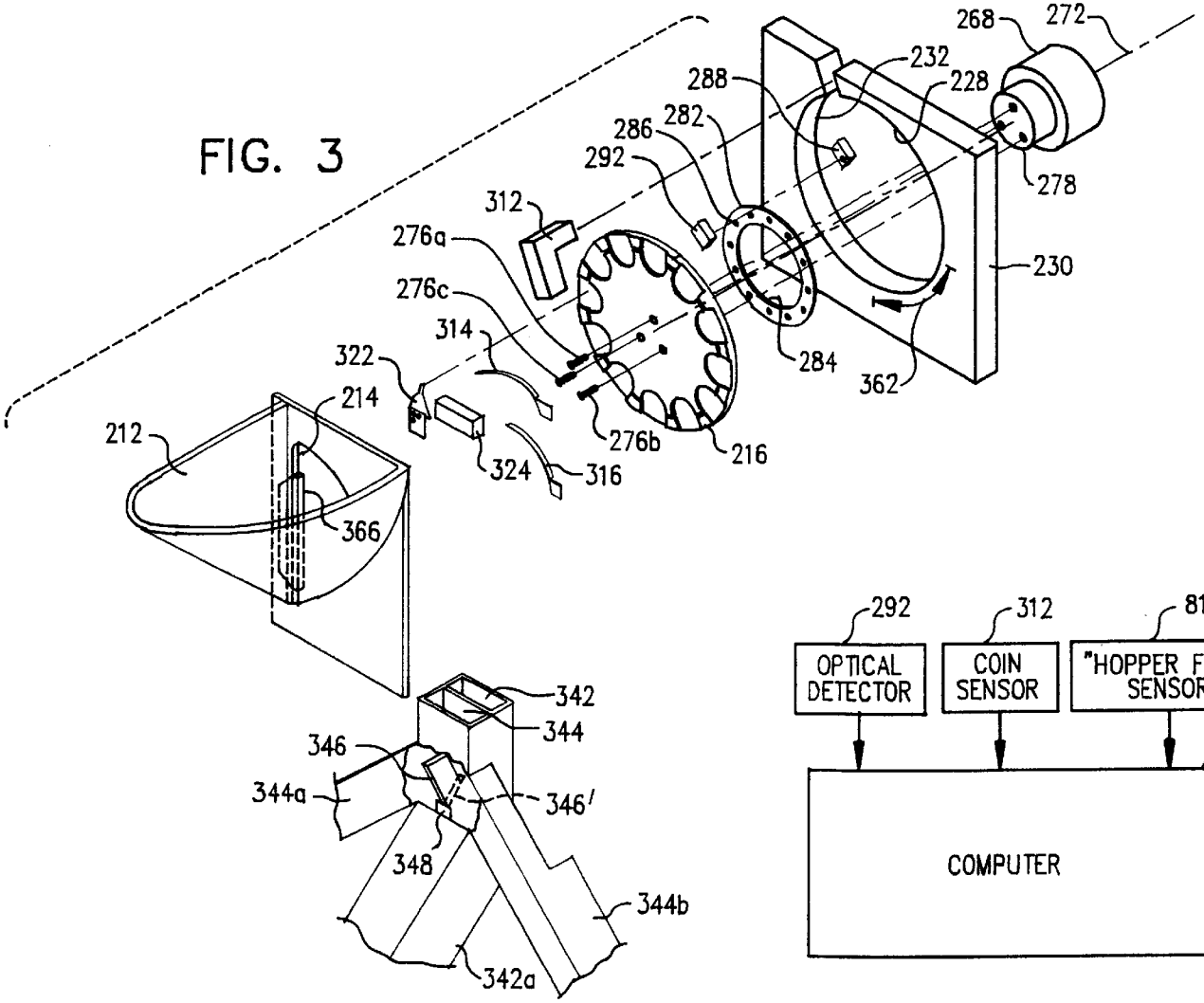
FIG. 3 is a partial exploded perspective view of the device of FIG. 2.

As shown in FIG. 3, the disk 216 is rotatably mounted in an opening 228 formed on a plate 230. Preferably, the opening 228 provides a flange 232 positioned behind the perimeter or edge of the rear surface of the disk 216. Preferably, the edge of the disk 216 is beveled 234 (FIG. 5), which may help prevent items such as rubber bands from being lodged between the rim of the disk 216 and the edge of the plate 230 or flange 232, eventually slowing or braking the disk 216.

Because of the influence of gravity, the mass of coins will reside near the bottom of the bowl. The cumulative effect of the mass of coins is believed to lead to a tendency to deflect the bottom edge of the disk 216 in a direction 618 towards the flange 232. With sufficient deflection, the disk 216 can rub against the flange 232, creating a braking effect. Accordingly, sufficient clearance, such as about 0.03 inch (about 0.75 mm) 622, is preferably provided to avoid this effect. Preferably, spaces and cracks in the device which might otherwise be large enough to receive or jam a coin are filled with a foam or other material to avoid jamming or loss of coins. Although the flange 232 may be provided with foam rubber or other sealant over much of its extent, such foam rubber is preferably absent from the coin pickup region 362.

Figure 5:
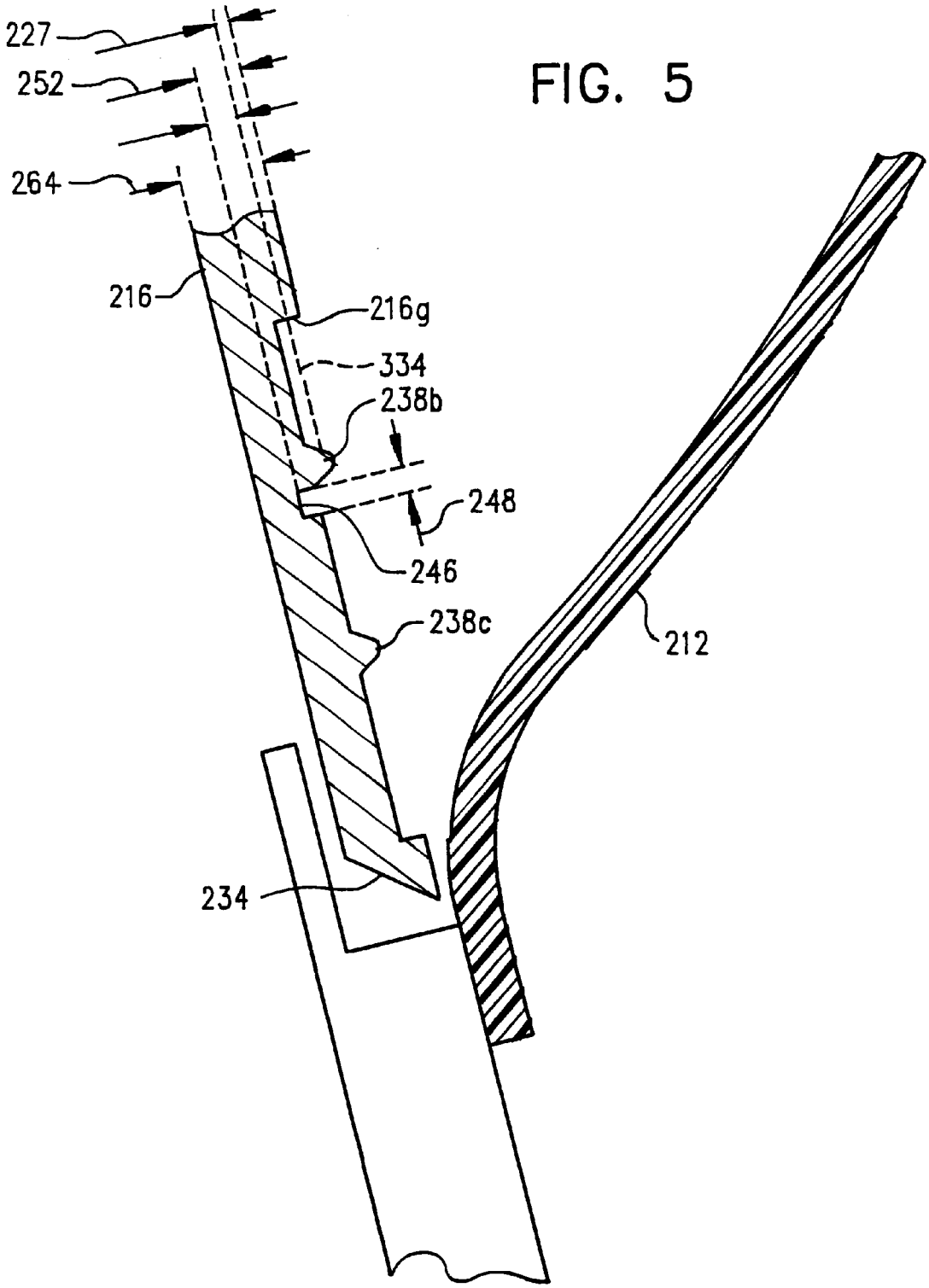
FIG. 5 is a cross-sectional view taken along line 5—5 of FIG. 2.

In the depicted embodiment, the bottom surface of the pockets 224 are provided with ribs or ridges 238(*a–e*) which preferably extend along an axis 240 (FIG. 2) at an angle 242, with respect to the disk radius 244, between about 40 degrees and about 50 degrees, preferably about 45 degrees. An annular groove or trough 246 having a radial extent 248 of about 3 inches (about 75 mm) and a depth 252 (with respect to the disk outer surface) of about 0.1 inches (about 2.5 mm) is formed in the pocketed surface of the disk, concentric with its rotation axis. Preferably, the pockets 224 have a depth 227 which is less than the thickness of the thinnest coin to be accepted by the device (where the depth of the pocket 216 is calculated from the outer surface of the disk to the tops of the ridges 238*a*, 238*b*, 238*c*, as shown in FIG. 5). For example, in the case of a machine configured to accept U.S. coins, the thinnest U.S. coin is a U.S. dime, and the depth 227 of the pockets 224 are preferably about 0.06 inches (about 1.5 mm). Preferably, the depth of the pocket is sufficiently shallow that it does not contain two stacked coins of the thinnest denomination (such as dimes, in the case of U.S. coins). Preferably, the edges of the pockets are relatively sharp, such as providing an edge radius of about 0.001 inch (about 0.025 mm) or less.

In the depicted embodiment, the disk 216 has an overall thickness 264 of about 0.125 inches (about 3 millimeters), and a diameter 266 of about 7 inches (about 18 centimeters). In general, the size of the disk 216 should be sufficiently small to result in a loaded mass which is small enough not to overload the motor 268 at the desired rotation rate (as described below), but the disk should have sufficient thickness 264 to avoid an undesirable degree of deflection of the disk 216 (such as may result in friction braking from contact with the flange 232). The disk should provide enough room to position the pockets 224 at a radius 244 from the axis of rotation 272 to achieve the desired throughput (e.g., as measured by the rate of coins transported past the sensor), and the desired influence (or lack thereof) of inertial or centrifugal force on the coins in the pockets (as described below). Preferably the device is able to acheive, with fully-loaded pockets, a throughput of at least about 500 coins per minute, preferably about 600 coins per minute, more preferably 700 coins per minute and even more preferably, at least about 850 coins per minute. When the disk is rotating at 60 RPM and contains 12 coin pockets, the maximum acheivable coin throughput (for a device which has a single rotating disk) will be 720 coins per minute, and the maximum acheivable throughput at a rate of 72 RPM will be 864 coins per minute. Although it might be thought that throughput may always be increased by increasing the rotation rate, it has been found that, within certain windows, throughput of counted or discriminated coins is increased by decreasing the rotation rate (e.g., from about 72 RPM to about 60 RPM), because this tends to facilitate coin pickup (i.e., positioning coins in pockets), reducing the number of empty pockets.

A number of materials can be used for forming the disk 216. In one embodiment the disk 216 is formed from G-10 epoxy board of the type commonly used for printed circuit boards (PCBs). The disk 216 can also be formed of numerous other materials, including metals, reinforced metals, ceramics, reinforced ceramics, metal disks with ceramic inserts, plastics (such as that sold under the trade name of Delrin), fiberglass, resins, reinforced resins, and the like. In one embodiment, all or a portion (such as annular portion 274) of the pocketed surface of the disk, and particularly the pocket edges, is covered with a wear-resistant material such as silicon carbide or other ceramic coating.

Figure 9:
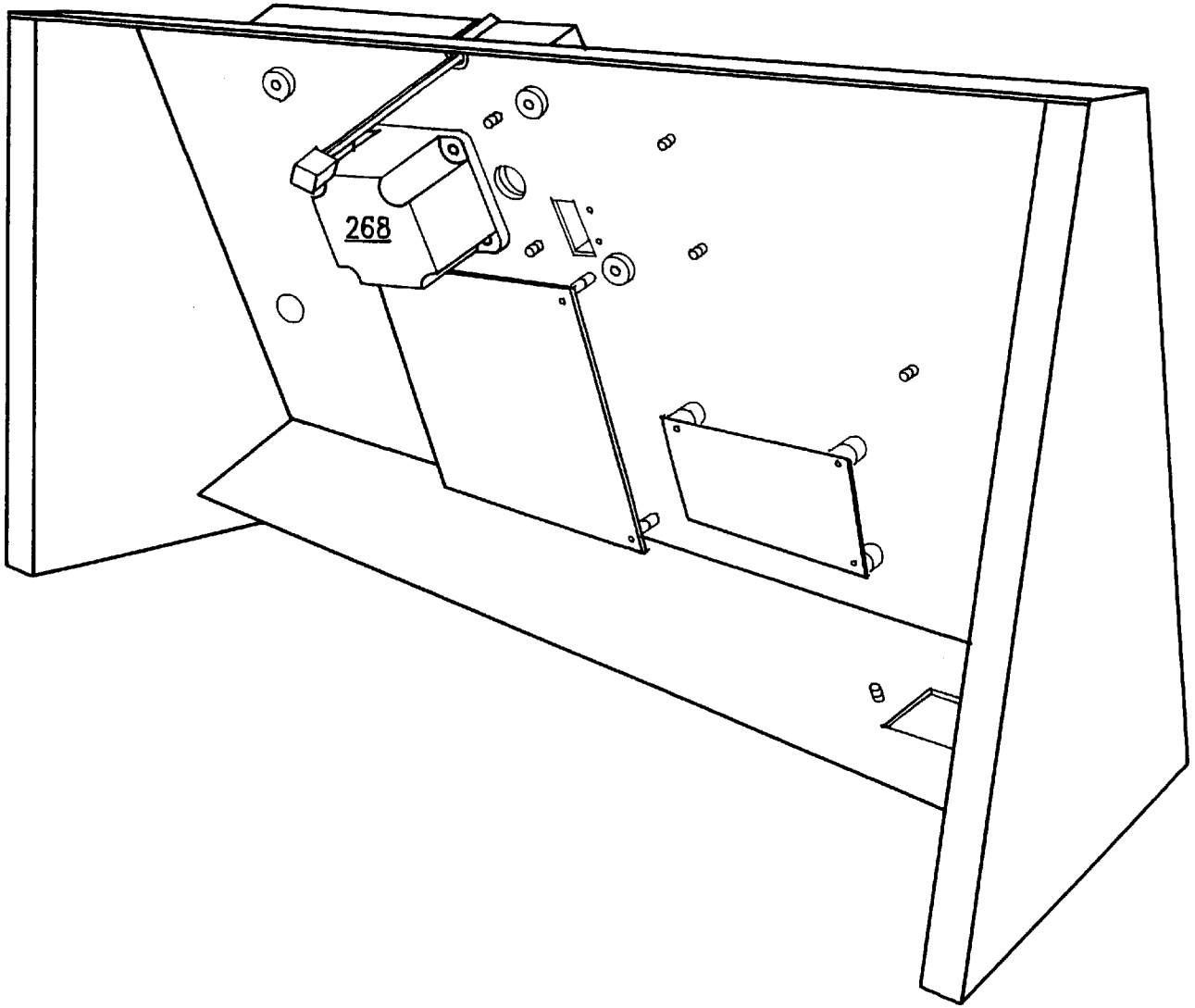
FIG. 9 is a rear perspective view of the device of FIG. 8.
Figure 10:
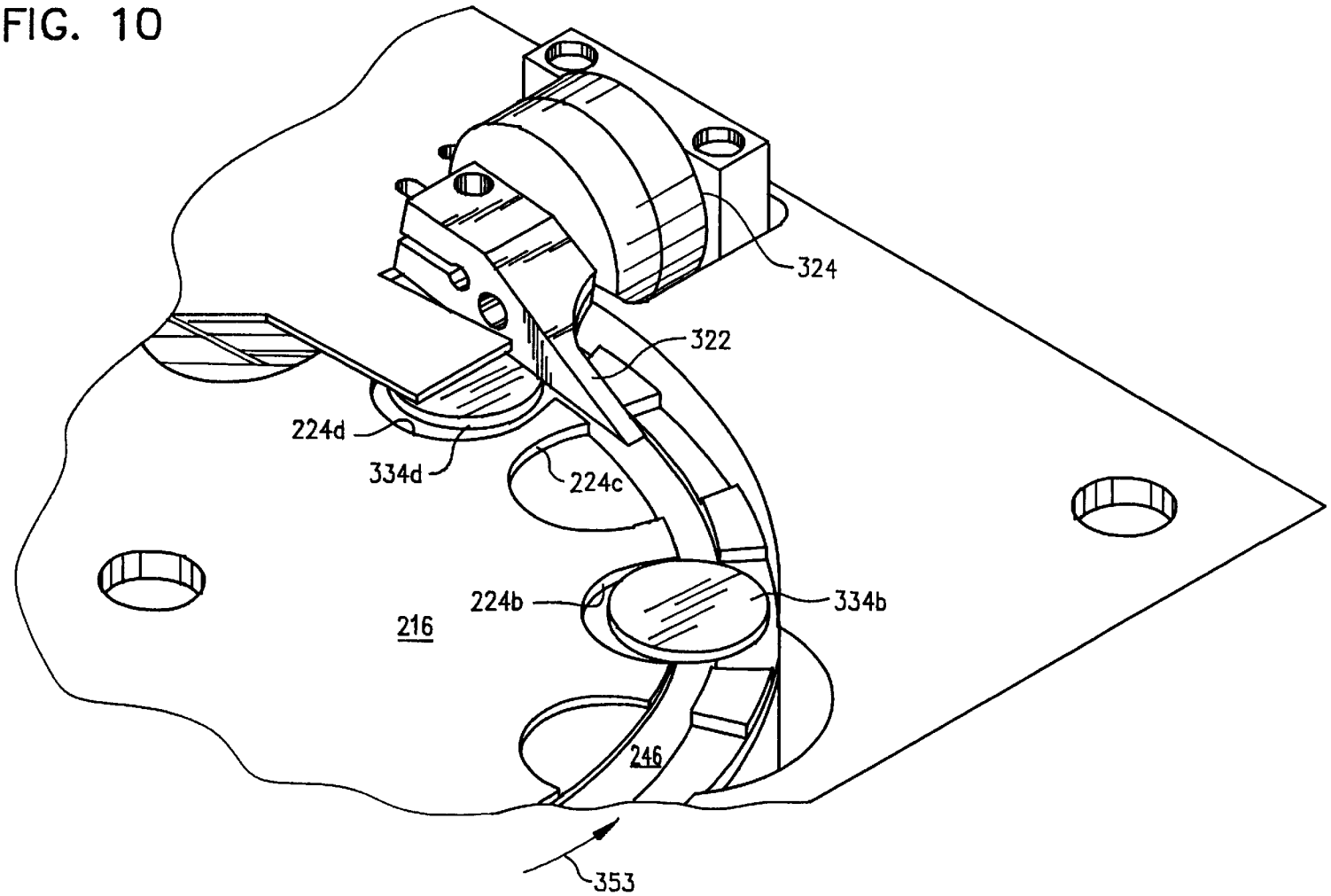
FIG. 10 is a partial perspective view of a coin disk and ramp according to an embodiment of the present invention.

As shown in FIG. 3 the disk 216 is positioned concentrically in opening 228 by coupling (e.g., via screws 276*a*, 276*b*, 276*c*) to the output shaft 278 of concentrically-mounted motor 268. Motor 268 may be concentrically mounted in a number of fashions, e.g., as depicted in FIG. 9. Although the depicted embodiment shows the disk 216 directly mounted to the output shaft 278 of the motor 268, other types of transmissions are possible, including belt-drive transmissions, gear transmissions, and the like. Preferably, the motor 268 provides a relatively vibration-free and very smooth motion. In general the smoother the operation of the motor and of the moving parts (such as having little or no undesired vibration) the more stable the coin as it passes the sensor. A number of types of motors can be used, including electrical motors such as an alternating current (AC) motor, a stepper motor, and the like. In one embodiment, an AC synchronous is used, such as Model SS60, available from Oriental Motors.

In the depicted embodiment, a timing disk such as optical timing disk 282 is also mounted concentrically with the axis of rotation 272. In the depicted embodiment, timing disk 282 has a circular concentric opening of a size allowing the disk to be press-fit onto the output shaft 278 of the motor 268. In the depicted embodiment, the timing disk 282 includes 12 evenly spaced concentric holes 286 with a (preferably infrared) light source 288 and detector 292 mounted in a stationary position with respect to the plate 230, on opposite sides of the timing disk 282, radially aligned with the holes 286. In this way, as the motor 268 rotates the timing disk 282 (along with the disk 216), the detector 292 will detect light from the source 282 as each hole 286 rotates into alignment with the detector 292. A signal indicative of such light detection may be communicated (e.g., via a wire or a wireless link) to a control device, as described more thoroughly below. Preferably, the timing disk 282 contains 12 evenly-spaced holes 286, each one corresponding to one of the 12 pockets in the disk 216 to provide, upon each rotation of the disk 216, twelve pulses at detector 292, each corresponding to one of the pockets. In the depicted embodiment the phase of detected light pulses, with respect to, e.g., the pocket positions of the disk 216, may be adjusted by rotating the press-fit timing disk 282 with respect to the output shaft 278 about the common axis 272. Other manners of detecting the rotational position or rate of the disk 216 can be provided, as will be apparent to those with skill in the art, such as placing or coupling optically, mechanically or magnetically detectable marks or sources on the disk 216 or the motor shaft 278.

As depicted in FIG. 3, preferably one or more fingers 314, 316 are positioned adjacent the pocketed surface of the disk 216 in approximately the one o'clock and three o'clock positions, and extending across at least a portion of, and preferably beyond, the annular region occupied by the pockets 224. As described below, the fingers 314, 316 are provided to assist in repositioning coins or other objects which are not properly seated in pockets, such as coins which may have adhered to the front surface of the disk 216 or to other coins. In addition to, or in place of, the fingers 314, 316, other devices for moving improperly-positioned coins or other objects can be used, such as rigid bars, brushes, levers, and the like. In one embodiment, the fingers 314, 316 are made of stainless steel, preferably with sufficient strength to move the coins as desired, but with sufficient resiliency to deflect so as to avoid jamming. In the depicted embodiment, a stripper plate 366 is positioned on the left portion of the bowl 212 (in the view of FIG. 3) to prevent coins or other objects which may have adhered to the surface of the disk, without residing in pockets, from exiting the bowl in a manner so as to cause a jam or to move to a location other than an acceptable location (i.e., reject chute 342, acceptable coin chute 344, or trap 352). The depicted vertical position of the stripper wall 366 can be determined empirically, and has been found to significantly affect efficiency of the device.

One or more coin sensors or discriminators 312 are provided in such a position as to permit detection or discrimination of coins or other objects in the pockets 224. In the depicted embodiment, an electromagnetic discriminator 312 is positioned adjacent the pocketed surface of the disk 216 approximately in the eleven o'clock position in the view of FIG. 2.

Some types of sensors 312 are sensitive to the presence of ferrous metals. Accordingly, in one embodiment, the plates 230 are formed of aluminum. Preferably, the discriminator 312 is mounted to permit adjustment of the position of the sensor in a radial direction 314. Preferably, the discriminator 312 is configured to provide and output signals of a nature which permits automatic coin discrimination, preferably permitting at least discrimination of coins from non-coin objects and, more preferably, also permitting discrimination from non-acceptable coins (e.g., coins of one or more predetermined countries, from coins of other countries) and, even more preferably, permitting discrimination among various coin denominations (e.g., permitting discrimination of U.S. pennies, nickels, dimes, quarters, half dollars, and dollars from one another). Preferably, output from the discriminator 312 is provided via a communication link such as a wire or, a wireless communication link (such as an infra red (IR) communication link, and the like, not shown) to a control device and/or counting device.

A number of types of detectors or discriminators can be used, including electromagnetic, magnetic, optical, acoustic, capacitive, and the like. In one embodiment, the detector can be of the type described in U.S. patent application Ser. No. 08/807,046, which is a continuing application claiming priority in U.S. patent application Ser. No. 08/672,639 filed Jun. 28, 1996, both commonly assigned herewith and incorporated herein by reference, and/or U.S. patent application Ser. No. 08/883,780 filed on even date herewith, commonly assigned herewith and incorporated herein by reference.

Figure 13A:
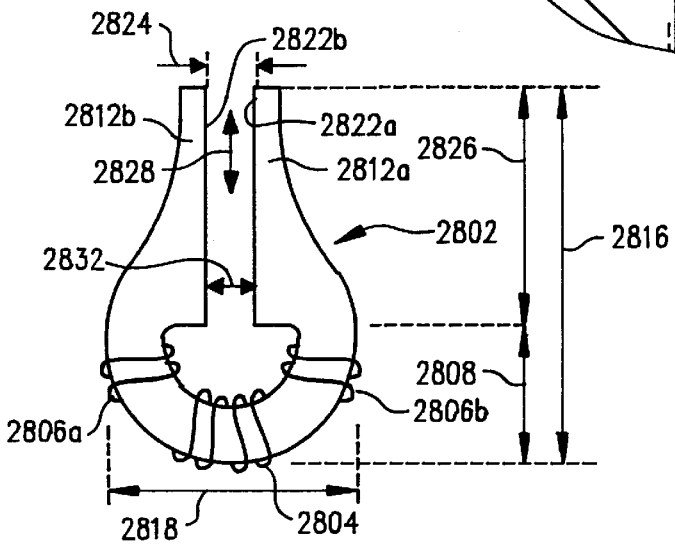
FIGS. 13A and 13B are front and side elevational views of a sensor core usable in connection with an embodiment of the present invention.
Figure 13B:
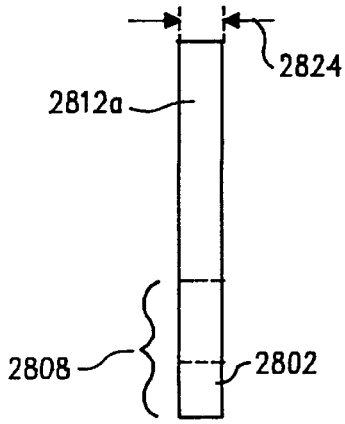

Briefly, in one embodiment, the sensor uses a magnetic core 2802 (FIGS. 13A, 13B) with low-frequency 2804 and high frequency 2806*a* and 2806*b* windings on the core. The core 2802, in the depicted embodiment, is generally U-shaped with a lower annular, semicircular, square cross-sectioned portion 2808 and an upper portion defining two spaced-apart legs 2812*a*, 2812*b*. The facing surfaces 2822*a, b* of the legs 2812*a, b* are, in the depicted embodiment, substantially parallel and planar and are spaced apart a distance 2824 of about 0.3 inches (about 8 mm). With the sensor positioned as depicted in the operating configuration, the upper leg 2812*a* of the core is spaced from the lower leg 2812*b* of the core by the inter-face gap 2824 to define a space for coin passage through the inter-leg gap. The core 2802 may be viewed as having the shape of a capped torroid with extended legs 2812*a*, 2812*b* with parallel faces 2822*a, b*. Without wishing to be bound by any theory, it is believed that the extended faces provide relative insensitivity to the vertical 2828 or horizontal 2832 position of coins therein so as to provide useful data regardless of moderate coin bounce and/or wobble as a coin passes through the gap 2824. It is believed the extended legs provide tolerance to system variation in coin positional registration that can result from, e.g., the action of gravity, friction and/or inertial forces on the coin.

In the depicted embodiment a low frequency winding 2804 is positioned at the bottom of the semicircular portion 2808 and the high frequency winding is positioned on each leg 2806*a, b* of the semicircular portion. In one embodiment the low frequency winding is configured to have an inductance (in the driving and detection circuitry described below) of about 4.0 milliHenrys and the high frequency winding 2806*a, b* to have an inductance of about 40 microHenrys. These inductance values are measured in the low frequency winding with the high frequency winding open and measured in the high frequency winding with the low frequency winding shorted together.

In general, the sensor or transducer provides a portion of a phase locked loop (PLL) part of a circuit, which is maintained at a substantially constant frequency. As a coin passes through the transducer's slot, there is a change in the circuit's reluctance. This is seen by circuitry as a change in the inductance value and a change in the amplitude of the excitation waveform. By changing a Voltage Controlled Oscillator (VCO) input voltage in accordance with the change in inductance due to the presence of a coin, the frequency of oscillation can be maintained. This VCO input voltage is the signal used to indicate change of inductance in this circuit. Amplitude measurement of the sinusoidal oscillator waveform is accomplished 2914*a, b* by demodulating the signal with a negative peak detecting circuit, and measuring the difference between this value and the DC reference voltage at which the sinusoidal signal is centered. In one embodiment, a parameter such as the size or diameter of the coin or object is indicated by a change in inductance, due to the passage of the coin, and the conductivity of the coin or object is (inversely) related to the energy loss (which may be indicated by the quality factor or "Q.") while a signal related to change in inductance, and thus to coin diameter is termed "D." Although the D signal may not be purely proportional to diameter (e.g., being at least somewhat influenced by the value of Q) and Q may not be strictly and linearly proportional to conductance (e.g., being somewhat influenced by coin diameter) there is a sufficient relationship between signal D and coin diameter and between signal Q and conductance that these signals, when properly analyzed, can serve as a basis for coin discrimination.

Figure 14A:
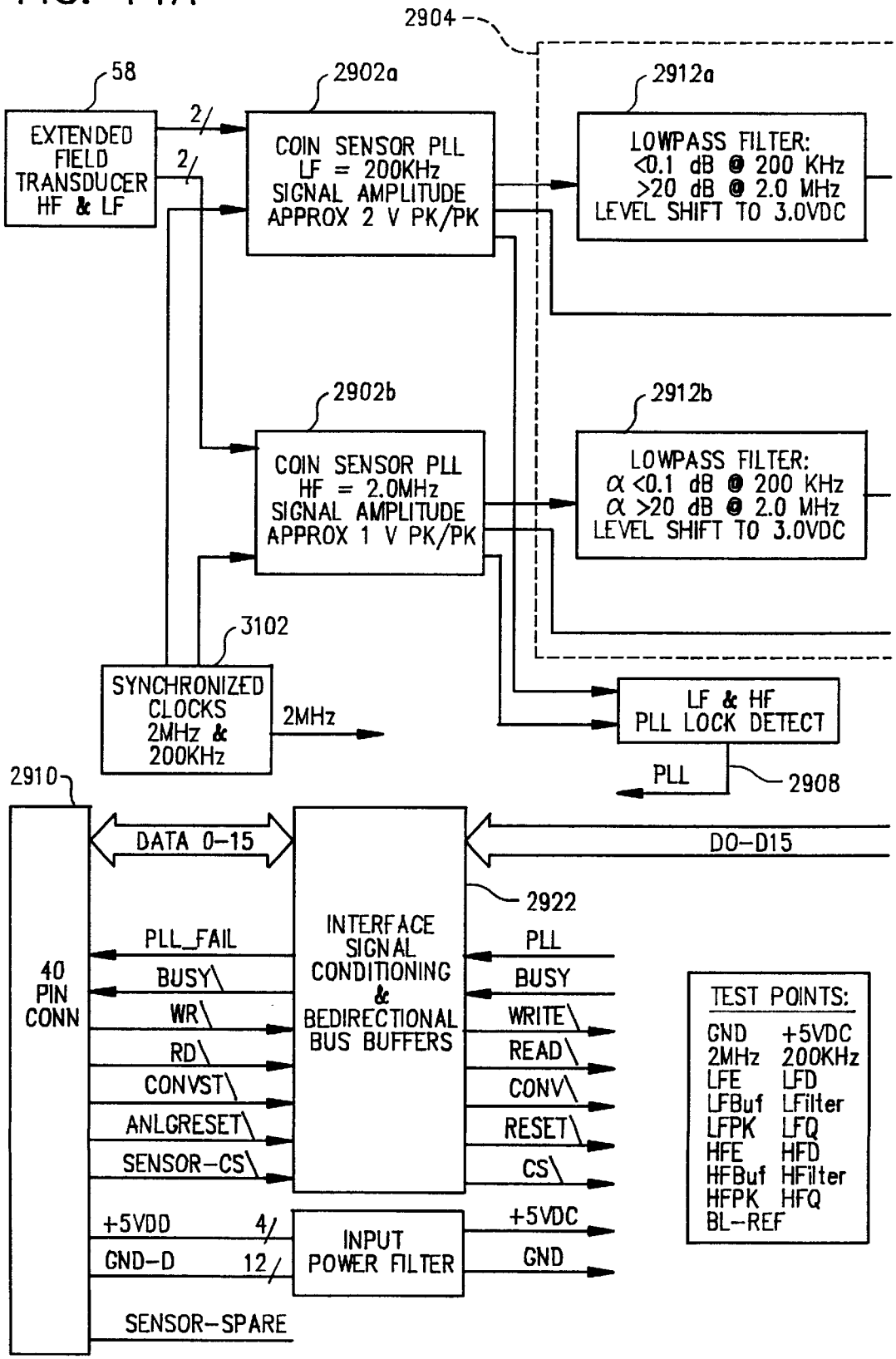
Figure 14B:
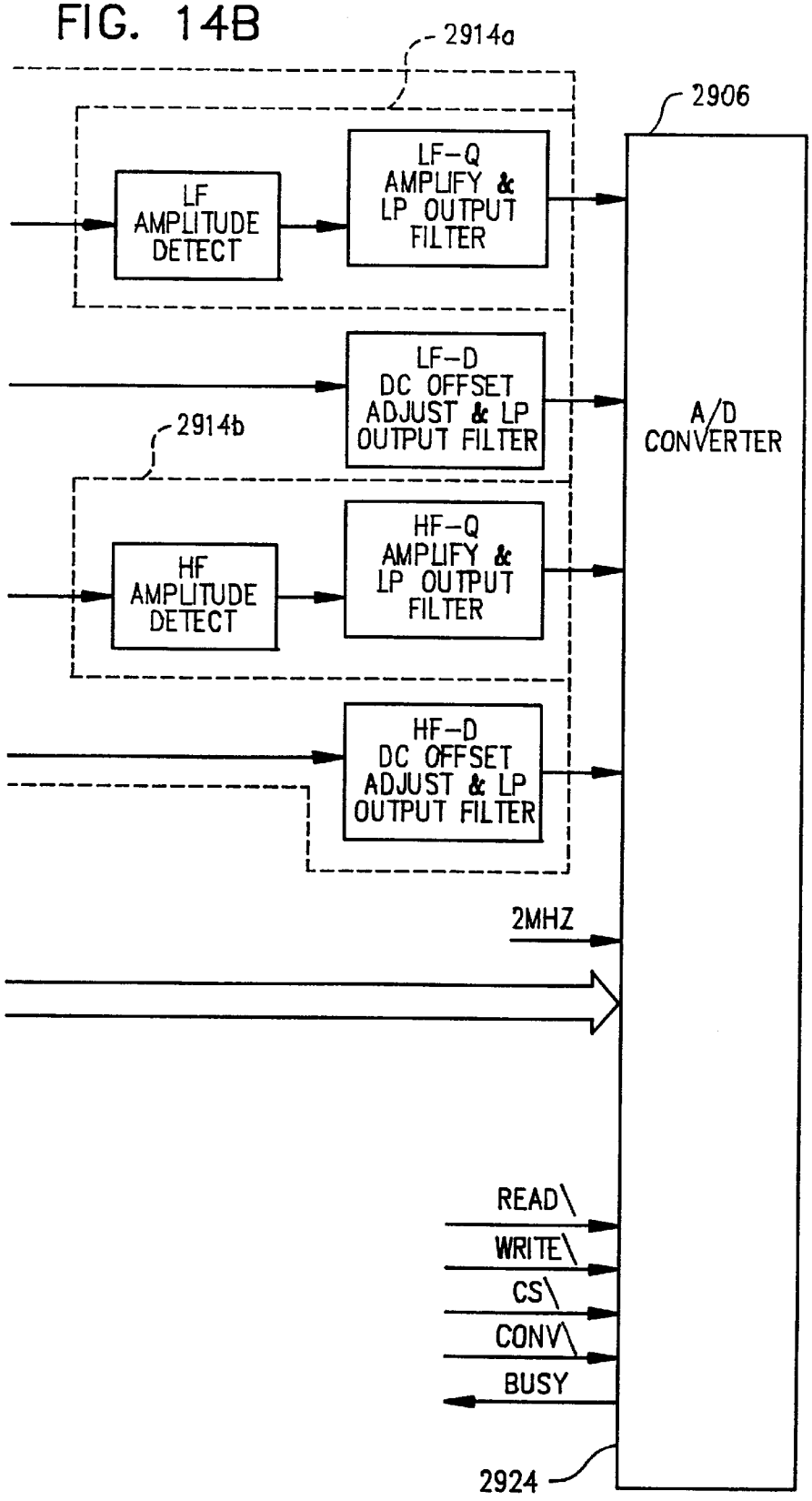

In the embodiment of FIGS. 14A and 14B, the low frequency coil leads are provided to a low frequency PLL 2902*a* and the high frequency leads are provided to high frequency PLL 2902*a, b*. The coin sensor phase locked loop, which includes the sensor or transducer 312, maintains a constant frequency and responds to the presence of a coin in the gap 2824 by a change in the oscillator signal amplitude and a change in the PLL error voltage. The winding signals (2 each for high frequency and low frequency channels) are conditioned at 2904 and sent to an analog-to-digital (A/D) converter 2906. The A/D converter samples and digitizes the analog signals and passes the information e.g. to a micro-controller. As a coin passes through the transducer, the amplitude of the PLL error voltage 2908 ("D" signal) and the amplitude of the PLL sinusoidal oscillator signal ("Q" signal) decrease. The PLL error voltage is filtered and conditioned for conversion to digital data. The oscillator signal is filtered, demodulated, then conditioned for conversion to digital data. Since these signals are generated by two PLL circuits (high and low frequency), four signals result as the "signature" for identifying coins.

In one embodiment, the different frequencies are used. Without wishing to be bound by any theory, it is believed use of different frequencies facilitates the probing of different depths in the thickness of the coin. It is believed this method is effective because, in terms of the interaction between a coin and a magnetic field, the frequency of a variable magnetic field defines a "skin depth," which is the effective depth of the portion of the coin or other object which interacts with the variable magnetic field. Thus, in this embodiment, a first frequency is provided which is relatively low to provide for a larger skin depth, and thus interaction with the core of the coin or other object, and a second, higher frequency is provided, high enough to result in a skin depth substantially less than the thickness of the coin. In this way, rather than a single sensor providing two parameters, the sensor is able to provide four parameters: core conductivity; cladding or coating conductivity; core diameter; and cladding or coating diameter. Although it is anticipated that, in many instances, the core and cladding diameters will be similar, obtaining both measurements can be useful since there may be some coupling of the Q and D signals, and it may be helpful in defeating certain types of counterfeit coin schemes, such as so-called cloaking schemes. Preferably, the low-frequency skin depth is greater than the thickness of the plating or lamination, and the high frequency skin depth is less than, or about equal to, the plating or lamination thickness (or the range of lamination depths, for the anticipated coin population). Thus the frequency which is chosen depends on the characteristics of the coins or other objects expected to be input. In one embodiment, the low frequency is between about 50 KHz and about 500 KHz, preferably about 200 KHz and the high frequency is between about 0.5 MHZ and about 10 MHZ, preferably about 2 MHz.

In the depicted embodiment, results of the coin discrimination analysis are used in controlling the path of coins. A controllably-movable ramp 322 is positioned adjacent the pocketed surface of the disk 216 in such a manner as to move, in response to activation of a solenoid 324, between a down position (FIG. 7A) and an up position (FIG. 7B). The ramp 322 tapers toward the leading edge 328 to a finger 332 of a size and shape such that it can fit into the annular groove 246. The ramp 322 is preferably formed of full hard stainless steel to provide for sufficient durability. Preferably, the ramp 322 has a thickness of about 0.01 inches (about 0.25 mm) and is otherwise configured such that the leading edge 328 of the ramp 322, when the ramp is in the down position (FIG. 7A), is below the coin-contact plane 334 (see FIG. 5) of pockets 224, to avoid contact between the leading edge of the ramp 328 and the leading edge of a coin 334*c* in a pocket as the pocket moves past the ramp. Thus, when the ramp 322 is positioned in the down position (FIG. 7A) to divert a coin (or other object) from a pocket (as described more thoroughly below), the coin first contacts the upper surface of the ramp 322 at a location 336 spaced from the leading edge, so that a direct collision between a coin leading-edge and the ramp leading-edge is avoided. In this fashion, the solenoid preferably does not actively lift the coin, but, rather, the power to move the coin from a pocket is provided by the rotation of the disk. Thus, the tip of the ramp 322 is positioned underneath the coin at the time the leading edge of the coin first contacts the upper surface of the ramp.

In the depicted embodiment, the finger 322 is positioned at approximately the nine o'clock position of the disk 216. By positioning the ramp 322 at approximately the nine o'clock position, the diversion of the coins (after removal from the pockets) follows an approximately straight-line path. Furthermore, this position, in the depicted embodiment, provides sufficient time to analyze the data from the sensor 312 and control the ramp 322. It is preferred, however, to generally minimize or reduce the amount of time between detection by sensor 312 and diversion by finger 322, since this period represents the period of greatest opportunity for miscounts.

A reject chute 342 and acceptable-coin chute 344 are positioned with upper openings at approximately the eight o'clock position of the disk 216. Preferably, the lower opening 342*a* of the reject chute is formed as or positioned adjacent, a reject bin or container (not shown) for receiving rejected coins and/or rejected non-coin objects. In the depicted embodiment, coins or other objects diverted to the acceptable coin chute 344 can be directed to either of two or more arms 344*a*, 344*b* by a diverter paddle 346, which may be operated by a motor 348 to move between a first position 346 for diverting coin into one arm 344*b*, and a second position 356' for diverting coins into the other arm 344*a* (e.g., when it has been sensed that the coin bin or bag connected to arm 344*b* is full). In one embodiment, the diverter or paddle 346 is moved by an AC synchronous gear motor 348, available from Houser, at a rate of about 30 RPM.

In general, the device can be configured either so that the ramp 322 moves to the down position to remove non-coin objects from the pockets (letting acceptable coins rotate past the ramp), or so that the ramp moves to the down position to remove acceptable-coins from the pockets (letting non-coin objects or non-acceptable coins rotate past the ramp). It is preferred to use the latter method, picking out good coins and letting non-coin objects and debris rotate past the ramp. This is because, the actual device (ramp) is operating on a recognized coin with known properties (e.g. size and weight) whereas attempting to divert non-coin objects would require the ramp to operate on an object of unknown size and shape. Additionally, in the case of certain errors (e.g., where a coin was indicated as acceptable by the discriminator/controller, but not correctly treated by the ramp), it is believed preferable to err on the side of returning accepted and credited coins to the customer, rather than run the risk of erroneously diverting a valuable coin to the accepted bin or bag without properly crediting the customer. A system which diverts only valued coins to an acceptance bin or bag reduces or eliminates non-coin debris that, e.g., can jam in post-process equipment (equipment that processes coins from the bins or bags after they are removed from the coin-handling machine) reducing post-processing costs. Another reason for configuring the device to divert the accepted coins out of the pockets is that, upon reversal of the disk (following a "no more coins" signal), the items which remain in the bowl will end up in the reject bin. This will lead to a situation in which it is more likely that good coins will be uncounted and returned to the customer via the reject bin, rather than the alternative situation in which debris will be moved to the acceptable-coin bins or bags.

The solenoid 324 must be a solenoid which is sufficiently fast-acting to move the ramp between the up position and the down position in a period no greater than that required to rotate the disk 216 through an angle 348 defined by the space between adjacent pockets. In one embodiment, the time required to move the ramp to the down position is about five milliseconds. Although a solenoid 324 has been found to be sufficiently quick and reliable for the described function, it is also possible to use other devices for moving the ramp, such as a stepper motor. One example of a solenoid which can be used for this purpose is manufactured by Guardian.

Figure 11:
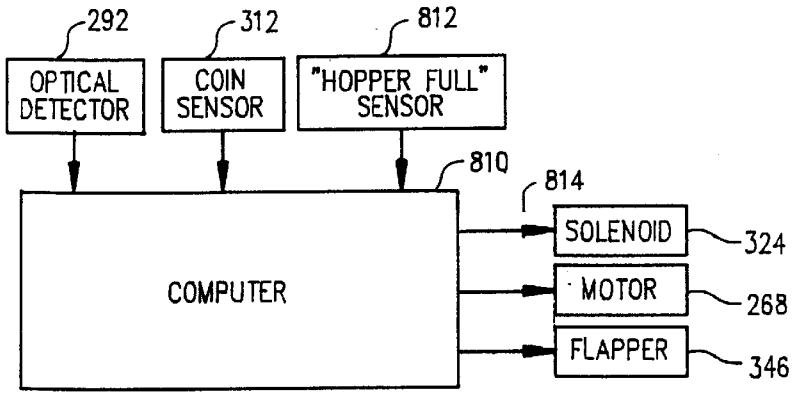
FIG. 11 is a block diagram of a control device showing inputs and outputs thereof according to an embodiment of the present invention.

FIG. 11 is a block diagram showing the relationship of a computer or other controller 810 to various input devices (such as the optical detector 292, sensor 312, and "hopper full sensor" 812), and the output signals to controlled components (such as the solenoid 324, a motor 268, and/or diverter flapper 346), according to one embodiment of the present invention.

Figure 12:
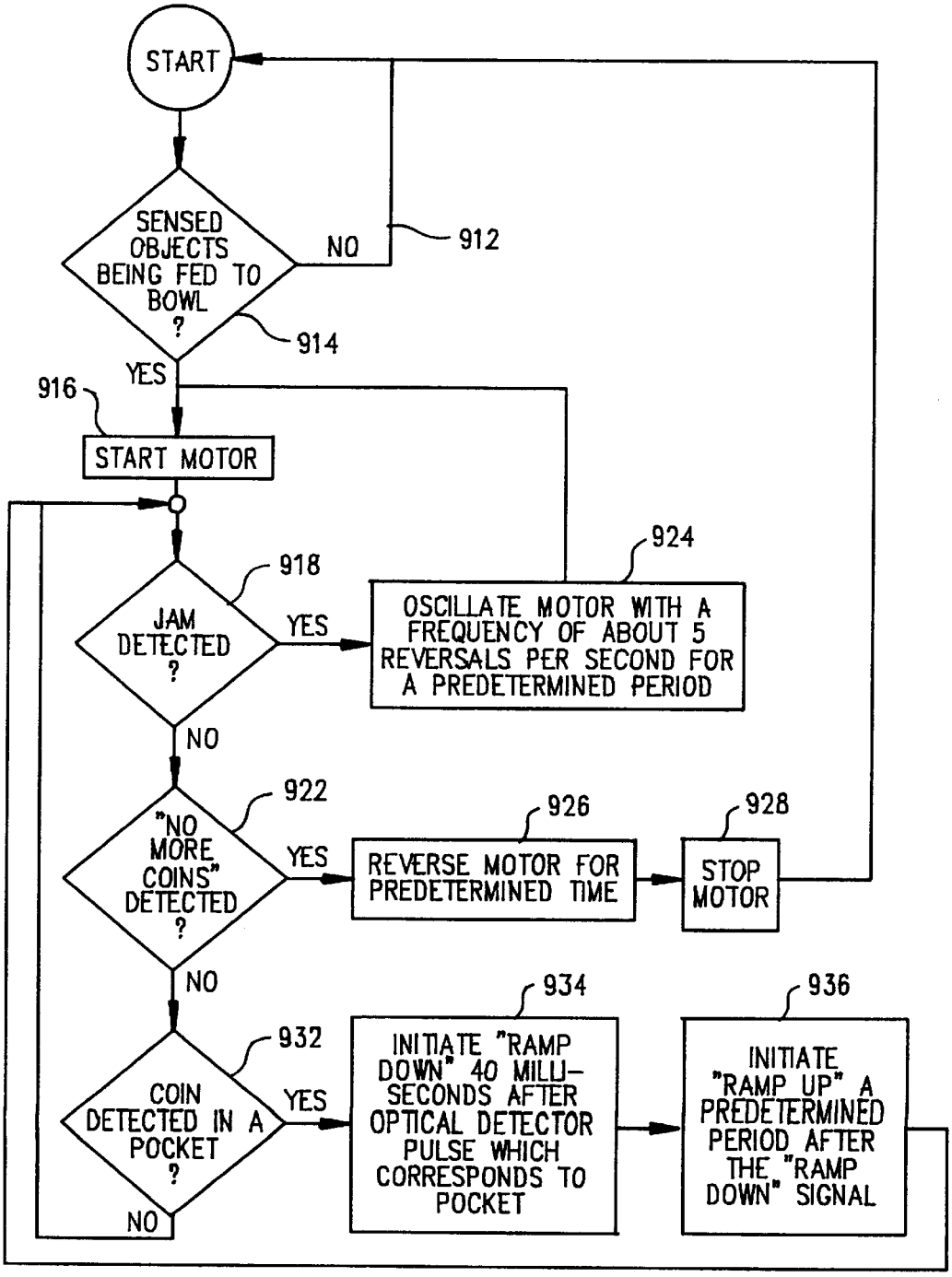
FIG. 12 is a flow chart of a control process of a type which may be used in connection with an embodiment of the present invention.

FIG. 12 is a flow chart of a procedure, preferably a computer-implemented procedure, for controlling a device according to an embodiment of the present invention, which may involve software being run on the computer or other controller 810. FIG. 12 illustrates only those portions of software for the singulation and transport functions and does not illustrate, for example, software for evaluating absence/presence, type and/or denomination of coins or other objects.

In operation, a mass or plurality of coins is fed, by a feed system 104, into the bowl 212. As shown in FIG. 12, the control system will reside in an idle state or loop 912 until the device has sensed that objects are being fed into the bowl 914. At this time, the control system will cause the motor to start in order to rotate the disk 216 and begin singulating and transporting coins.

During the time that the motor is running, the system will continuously monitor for detection of a jam 918 or detection of a "no more coins" result 922. Preferably, the device reacts to detection of a jam or other undesired stoppage of the rotation of the disk 216 in such a manner as to tend to clear the jam or other problem. One characteristic of the preferred AC synchronous motor, is that the motor tends to rapidly oscillate or vibrate, at about 60 hertz, when the drive shaft is jammed or otherwise stopped. This oscillatory movement tends to assist in clearing jams. Preferably, when the device detects a cessation or slowing of disk rotation 918 that persists for predetermined period of time (such as about 1 to 5 seconds), e.g., via a cessation of the train of pulses detected by detector 292, the controller will control the motor to undergo a "shake" mode 924, alternately moving the disk about 5 to 10 degrees in forward 353 and reverse 354 directions, with a relatively short period (e.g., about 200 milliseconds). Other devices for assisting in dejamming (not shown) include providing streams or jets of air (which may be relatively high pressure, short duration jets or streams, e.g., provided from a large reservoir of compressed air).

In one embodiment, when the sensor or discriminator 312 fails to detect any coins in any pockets for a predetermined period of time (such as 5 seconds) 922, the controller causes the motor to rotate the disk 216 in a reverse direction 926 (clockwise in the view of FIG. 2) 354, preferably, at about the same rate of 60 to 72 RPM. When the disk is rotated in the reverse direction, items contained in the bowl (e.g., unacceptable coins, non-coin objects, or coins which were not captured by pockets) are carried clockwise out of the bowl 312, typically about 10 to 15 degrees, before being ejected by inertia from the disk and moving into the reject chute.

After the motor is run in reverse 926 for a predetermined period (such as about 2 seconds), it is assumed that all the coins or other objects that had been introduced into the bowl have been discriminated or otherwise disposed of and accordingly the motor 268 is stopped 928 and the system idles until additional objects fed into the bowl are sensed.

In the absence of a jam or "no more coins" signal, the motor continues to rotate in the normal fashion to achieve coin pickup for transport to the sensor.

Figure 6A:
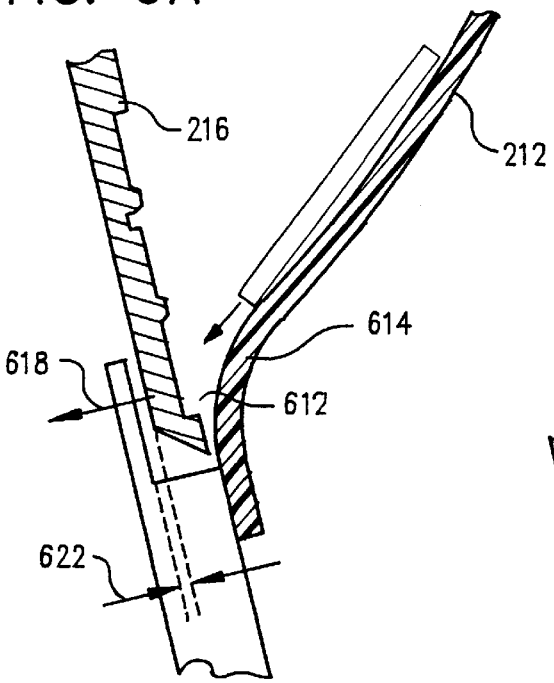
FIGS. 6A–6C are cross-sectional view corresponding to the view of FIG. 5, depicting coin movement into a coin pocket.
Figure 6B:
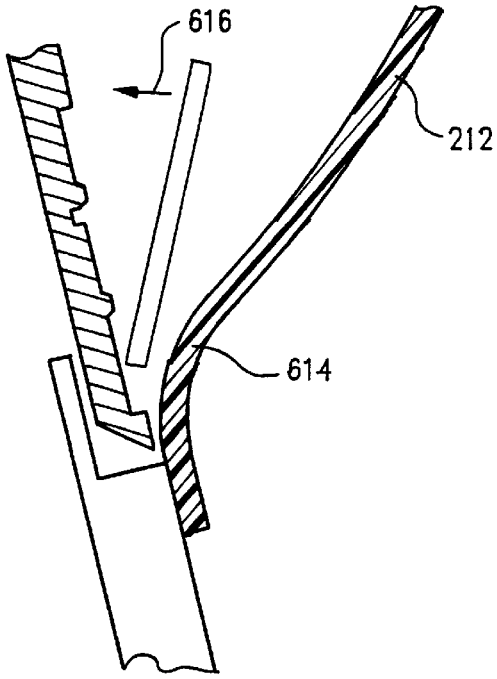
Figure 6C:
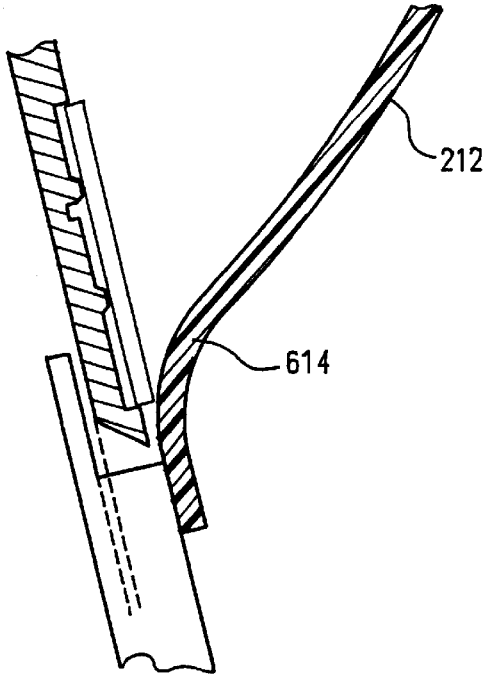
Figure 8:
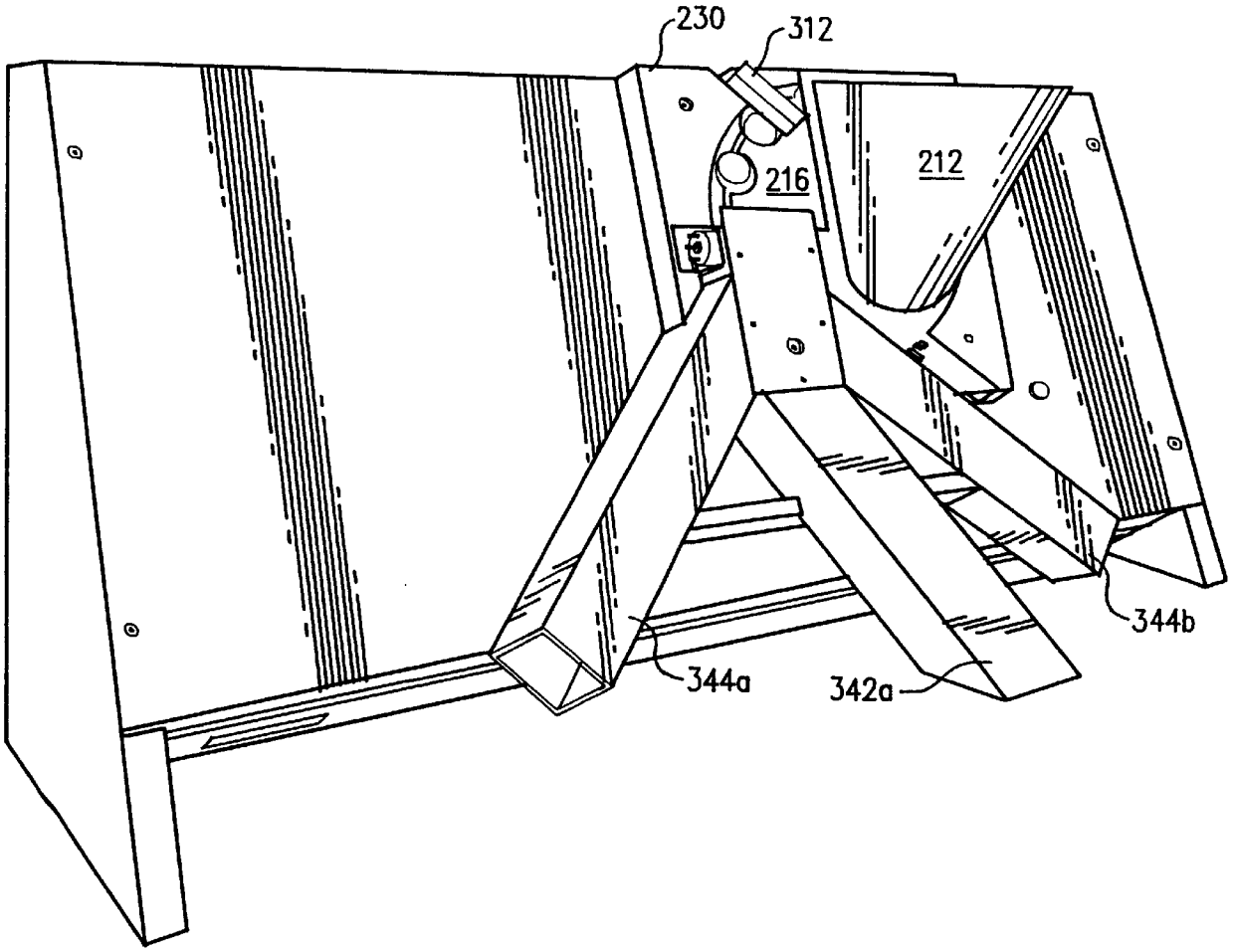
FIG. 8 is a front perspective view of a coin singulation and transport device according to an embodiment of the present invention.

In order to effectively position coins into pockets, the device is configured to urge the coins which reside in the bowl toward a position such that the plane of the coin is parallel to the plane of the disk. In one embodiment, as depicted in FIGS. 6A through 6C, the lower portion of the bowl 212 is configured to provide a trough 612 extending somewhat below the lower edge of the disk 212. A shoulder region 614 is positioned above the trough, and provides a "waterfall" effect such that, as coins slide down the wall of the bowl 212 under the influence of gravity, upon reaching the shoulder 614 the coins tend to flip or rotate, as shown in FIG. 6B, with the upper edge gaining a rotational momentum 616, tending to carry the coin in the desired direction, parallel to the disk 212 for engagement or "pickup" by a coin pocket, as depicted in FIG. 6C.

As coins are initially positioned in pockets near the four o'clock to five o'clock position, the force of gravity includes a radially outward component, which tends to reinforce the radially outward centrifugal force on the coins, positioning the coins in a radially-outward portion of the pockets. However, as the disk 216 rotates the coins to the upper portion of the disk, the force of gravity takes on a radially-inward component. Accordingly, in the position between about the one o'clock position and the eleven o'clock position, gravity forces begin to outweigh centrifugal (inertia) forces, and the coins tend to move from a radially outward position 334*l* towards a radially inward position 334*b*. When the sensor 312 is of a type which is sensitive to the radial position of the coin with respect to the sensor, it is believed useful to facilitate this movement to the radially-inward position, so that by the time the coins reach the sensor, they are registered in the pockets in a known radial position (preferably an inmost radial position) with respect to the sensor 312. One manner of facilitating this movement is to provide the ridges 238*a*, 238*b*, 238*c*, described above, which tends to minimize the area of contact between the coins and the disk, also minimizing friction and surface tension, particularly as coins slide within the pocket toward the desired registered position. This feature has been found to be especially useful when the coins are wet or are coated with an adhesive or sticky substance. Another feature that reduces or minimizes surface contact between the coins and the disk (such as dimpling, quilting, embossing, or texturing surfaces) can be used.

Although the depicted embodiment uses gravity advantageously for registering the coins in the desired radial position within the pockets, other manners of registering the coins within the pockets may also be used, such as by providing for a relatively fast RPM and/or large diameter of the disk, (relying on centrifugal (inertia) forces, in order to register the coins to the radially outward position), or providing for additional fingers or other mechanical guiding devices. It is also possible to adjust the angle 218 (FIG. 4) of the plate, in order to change the effective balance between inertial and gravitational forces. However, it has been found that a relatively shallow angle tends to lead to increased difficulty of stripping multiple or unwanted coins from pockets, which may lead to jamming.

Another approach to addressing the issues of coin positional registration is to configure, locate and/or position system sensors such that they are tolerant of coin positional variation.

In normal operation, by the time a pocket has rotated to the sensor position, the coins will be effectively singulated, i.e., the pocket will contain, at most, a single coin. When a pocket of the rotating disk carries the coin or other object underneath the sensor 312, the sensor detects one or more characteristics of the coin (such as a characteristic indicative of its conductivity, permissivity, diameter, thickness, plating or composition and the like). Data from the sensor 312 is provided to the computer 810, as shown in FIG. 11, and, in the preferred embodiment, is analyzed in order to determine whether the object in the pocket (if any) should be removed from the pocket by the ramp 322 or allowed to rotate past the ramp. A number of processes can be used for analyzing data to make this determination. Examples of processes which can be used for this purpose include those described in U.S. patent application Ser. No. 08/672,639 and application Ser. No. 08/883,780. Once the necessary determination is made, the computer or other controller 810 outputs a signal 814 to the solenoid 324 to control whether the solenoid will position the ramp 322 in the up position or down position.

Once the discriminator/controller has determined that a particular pocket contains an acceptable coin 932, the controller provides a "ramp down" signal 934 to the solenoid 324 at a time after the trailing edge of the preceding pocket has rotated past the leading edge of the ramp 332, and before the leading edge of the target pocket (i.e., the one containing the accepted coin) is rotated to the position of the leading edge of the ramp 332. In one embodiment, this is achieved by activating the solenoid 324 a predetermined period (such as about 40 milliseconds) after a pulse corresponding to the target pocket is detected by the detector 292. In one embodiment, the amount of time allowed for moving the ramp to down position, i.e., the amount of time for rotation through angle 348, is about 10 milliseconds. The device is believed to operate with reasonable reliability when the downtime tolerance is about one to two milliseconds.

Figure 7A:
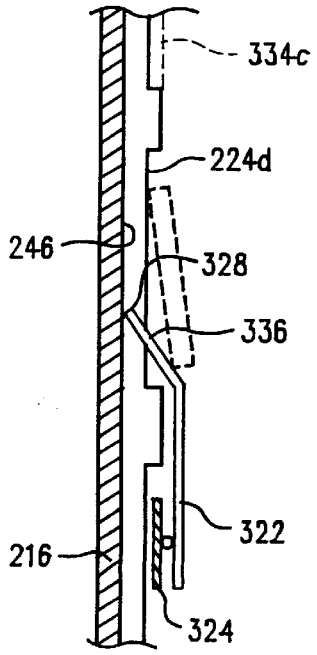
FIG. 7A is a cross-sectional view taken along line 7A—7A of FIG. 2.
Figure 7B:
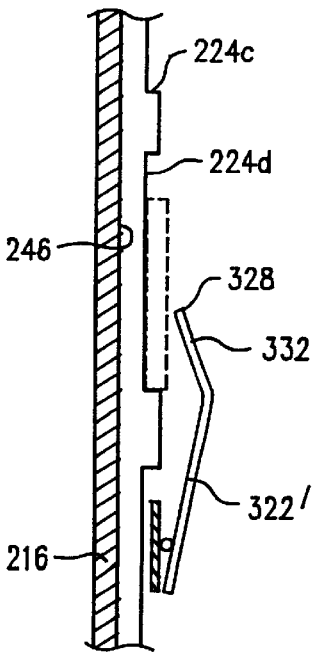
FIG. 7B is a cross-sectional view corresponding to the view of FIG. 7A, but showing the ramp in an up position.
Figure 14:
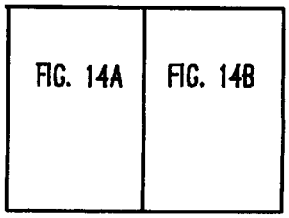
FIGS. 14A and 14B are a block diagram of functional components of a sensor circuit, usable in connection with an embodiment of the present invention.
Figure 2:
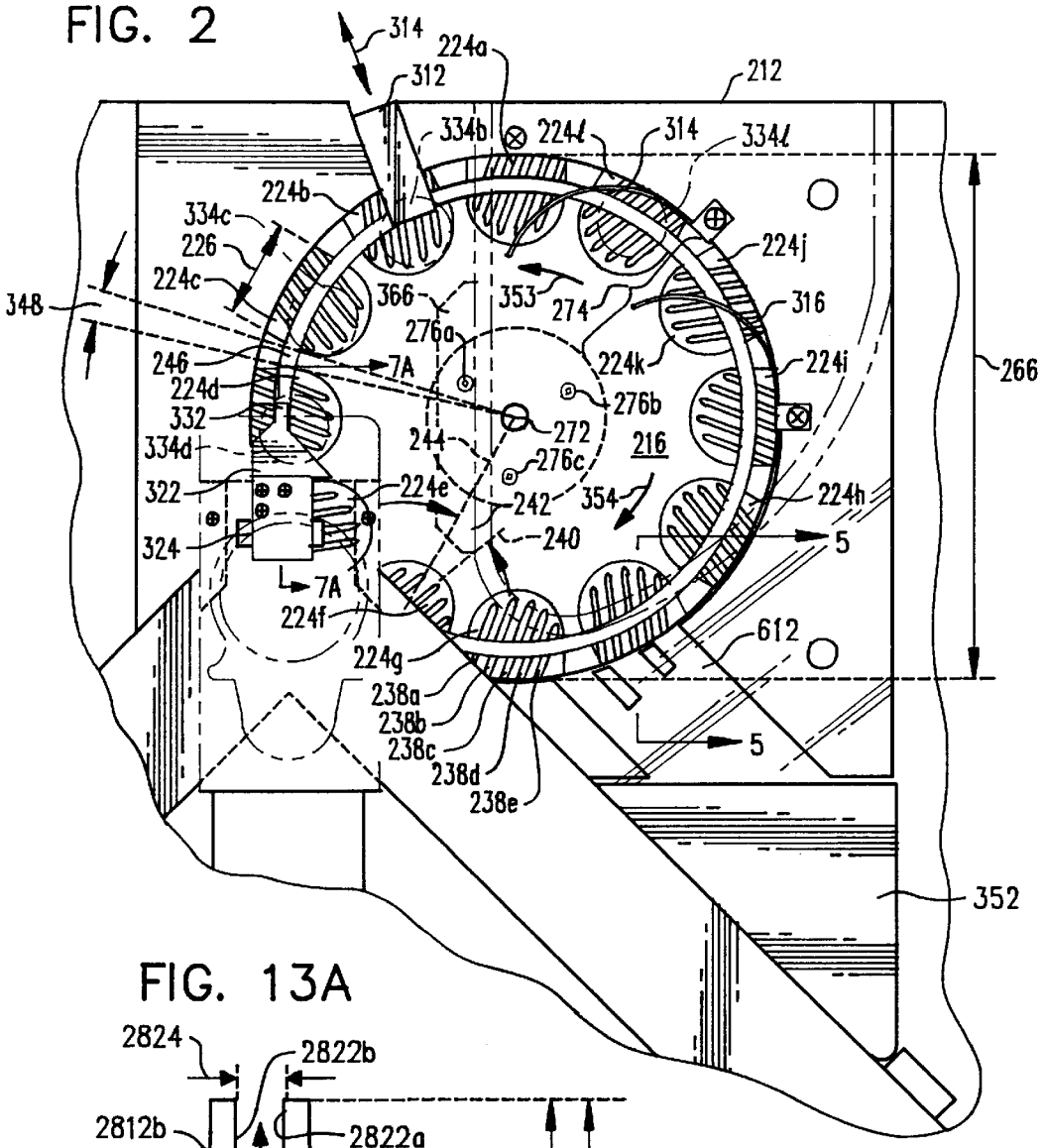
FIG. 2 is a front elevational view of a coin singulation and transport device according to an embodiment of the present invention.

Once the ramp 322 has moved to the down position, continued rotation of the disk 216 causes the coin (or other object) in the target pocket 224*d* to ride up the ramp 322, as depicted in FIG. 7A. The solenoid 324 deactivates in order to raise the ramp 322 to the up position 322', 936 at a time such that the leading edge of the ramp 322 will be assured of clearing the leading edge or a coin or other object 334*c*, in the next pocket 224*c*, should the object be an unacceptable object.

Coins or other objects which are not diverted out of a pocket by the ramp 322 are rotated past the position of the ramp and ejected, by their own inertia, from the pocket as the pocket reaches the position of the reject chute 342.

Several options are possible to handle situations in which acceptable coins are detected in two successive pockets. In one embodiment, the sensor/controller controls the solenoid 324 so that, after moving downward to remove the coin or other object from the first of the two successive pockets, the ramp is maintained in one down position as the first pocket rotates past the position of the ramp leading edge and the second of the two successive pockets rotates past the position of the ramp leading edge, thus causing ejection of the second of the two successive coins. A similarly-sustained down position of the ramp can be used for three or more successive pockets which have acceptable coins, which can reduce the amount of wear from repeated cycling.

Alternatively, the device can be configured so that whenever the ramp is moved to the down position to remove a coin or other object from a pocket, thereafter the solenoid is always deactivated so as to initiate lifting the ramp toward the up position before the next successive pocket rotates to the ramp leading edge position. Such second configuration may facilitate a simplification of the logic since each pocket is treated in the same manner without requiring different treatment for successive pockets that do and do not contain acceptable coins.

In either case, it has been found feasible to empirically determine both (1) the amount of delay between detection of a light pulse (from detector 292) and initiation of down movement of the ramp (or, equivalently, adjustment of the rotational position of the optical encoder in order to adjust to phase of light pulses with respect to pocket positions) and (2) the amount of delay between initiating movement of the ramp toward the down position and initiating movement of the ramp toward the up position (if the next-successive pocket is to be cleared by the ramp). In the depicted and described embodiment, in the example of a pocket containing an acceptable coin, followed by a pocket containing a non-coin object, one operable mode of use has been to initiate downward movement of the ramp about 5 milliseconds following detection of a pulse corresponding to the first pocket and to initiate upward movement of the ramp about 30 milliseconds after initiation of the downward movement. It has been found that an operable mode can be achieved if the phase for the optical disk is adjusted such that a pulse, corresponding to a particular pocket is generated about 5 milliseconds after the leading edge of such pocket first reaches the center line of the detector/discriminator 312. By judiciously positioning the optical detector 292 and adjusting the phase, it is possible to configure an operable device in which the optical pulse corresponding to a particular pocket is always the next optical pulse following an event (such as arrival of a pocket at a detector) and/or so that when down movement of a ramp is desired, proper timing is achieved by generating a signal which causes the solenoid 324 to be activated upon the occurrence of the next pulse from the optical detector 292.

In light of the above description, a number of advantages of the present invention can be seen. The coins or other objects to be sensed are moved in a positive-drive fashion past the sensor (as opposed to relying on gravity-driven, ramped, or other passive movement systems), creating a more predictable rate of movement past the sensor and the diverting mechanism, which, depending e.g. on the type of sensor used, can result in more accurate sensing and diversion of valued coins. A further advantage of the disclosed device is that the coins are contained, positively positioned and propelled past the sensor and diverted, reducing or minimizing the opportunity for losing or inaccurately diverting a coin. Such position propulsion provides the opportunity for faster throughput speeds than a passive, e.g. fully gravity-driven, system. Also, a powered system instrumented with appropriate sensors and controlled with software, e.g. as described above, can achieve self-recovery from jams, reducing field downtime and several costs. Additionally, the relatively uncomplicated configuration of the device reduces the number of locations where coins and/or non-coin debris can lodge, potentially causing machine jams. Furthermore, in some cases, by knowing the rate of movement past the sensor, the signal output by the sensor can be used to ascertain the diameter of the coin or other object (such as by multiplying the duration of the signal between the leading edge of the coin and the trailing edge of the coin times the known velocity of the coin past the sensor). The positive (or near-positive) control of the coin means that the coin is contained, preferably for the entire journey from pick-up past the sensor. The position of the coin is thus known, within a certain envelope, at all times during such containment, resulting in decreased complexity (e.g. of sensing and diverting hardware and software) and increased accuracy. Positive control provides more stability for the coins, giving the possibility of higher processing speeds, for the same level of stability or accuracy. By eliminating the need for gravity feed past the sensor, the present configuration reduces or eliminates the potential for coins to leave the intended path (to "fall off the rail") before, during and after their passage past the sensor.

The present invention provides for a relatively small number of parts to achieve the singulation, transport and diversion functions, and at a relatively low cost. The low part count also assists in providing the device as a low maintenance device. The depicted configuration with integrated hopper and sensor (and diverter) provides a relatively simple assembly and disassembly for lower fabrication and operating costs, and a low part count for low manufactured cost. The design accommodates a variety of sensor configurations including a gapped plate and a gapped torroid configuration.

The depicted flat disk is relatively inexpensive to manufacture and simple and inexpensive to service and requires little adjustment or maintenance. It is believed that, previously, flat disks were considered difficult to properly load and thus a poor choice. The bi-directional ramp at the bottom of the hopper assists in properly loading all coins into the disk pockets, even though the disk is flat.

The actuate-to-accept configuration of the diverter helps ensure safe and error free operation. Active acceptance increases accuracy because there is no need to try to hit or strike unrecognized and potentially odd-shaped debris and materials with a solenoid or pin. Actuate-to-accept configuration allows the machine to return unrecognized or unaccepted items, material or debris to the user, avoiding placing debris in an "acceptance" bin. The diverter configuration permits the use of a stepper motor for actuation of the diverter, rather than a solenoid, which offers superior reliability.

Although in one embodiment, the pockets are provided with a circular or "U" shape, other shapes could be provided, e.g. to assist in registering the coins with respect to the sensor. In one configuration, the pocket edge can be shaped so that the portion of the pocket edge which is at the bottom as the pocket approaches the sensor (approximately the eleven o'clock position) has, for example, a "V" shape to help the coin register under the sensor.

A number of variations and modifications of the invention can also be used. Although, in the depicted embodiment, an activatable ramp is used to divert or lift coins out of pockets, other devices for removing coins or other objects from pockets can be used. In one embodiment, coins may be removed by striking the opposite or rear surface (i.e. the surface opposite the surface which has the coin pockets) of the disk in the region of the pockets (preferably thin-floored pockets, such as 0.01 to 0.015 inch thick), with a quick (e.g., ten millisecond) pulse. This option, however, is not preferred since it has been found sometimes ineffective for coins which are sticky or coated with an adhesive material. In one embodiment, devices may be provided to impart vibration to the bowl of the coins within the bowl, such as by positioning protrusions on the disk 216, configured to periodically strike stationary surfaces as the disks rotate, to impart an impact or vibration. In some embodiments, it may be possible to provide a device which has two or more rotating pocketed disks or other coin singulation devices, such that the stream of input coins are divided among two or more singulators, rails, and/or sensors or the like, e.g. to acheive a higher throughput.

Although the described sensor can sense passive coins or other objects, it is possible to use the present invention in connection with a sensor which senses an active or reflective object. For example, coins or other objects may be provided with circuity or other devices configured to broadcast, transpond or reflect signals such as radio-frequency (RF) electromagnetic signals. A sensor can be used which senses such Rf signals to detect, discriminate and/or identify coins or other objects.

Although the invention has been described by way of a preferred embodiment and certain variations and modifications, other variations and modifications can also be used, the invention being defined by the following claims:

What is claimed is:

1. Apparatus for coin discrimination comprising:

a container for receiving a plurality of randomly oriented objects including one or more coins of at least one acceptable type, said container having at least one exit opening;

a disk rotatable about a rotation axis and mounted adjacent said exit opening, said disk having at least a first recess formed therein, sized and shaped to accommodate the at least one acceptable type, to define a coin pocket in said disk;

a sensor configured to output a first signal indicative of whether at least a first physical characteristic is representative of a coin being of a type included in the at least one acceptable type, said sensor positioned so that, during rotation of said disk, said pocket will move past said sensor;

circuitry, coupled to said sensor, configured to discriminate, in response to said first signal: (a) coins being of a type included in the at least one acceptable type, from (b) other of the objects;

a lever movable in response to said output, wherein said lever is capable of moving between (a) a first position for not contacting a contents of said pocket when said contents includes one of the other objects, and (b) a second position for contacting an edge of a coin being of a type included in the at least one acceptable type in said pocket, wherein in said second position said lever removes said coin from said pocket; and a plurality of protrusions on a surface of said pocket.

2. Apparatus, as claimed in claim 1, further comprising diverter means for removing any coin of a type included in at least one predetermined type positioned in said pocket, said diverter means positioned so that, during rotation of said disk, said pocket will move past said lever, and said diverter means induces a portion of said lever to reside in a groove annular about said rotation axis for removing the coin from said pocket.

3. Apparatus, as claimed in claim 2, wherein said lever comprises a ramp having a free end wherein said free end is controllably movable between said first position with said free end spaced apart from said groove, and said second position with at least a portion of said free end traversing a plane defined by a support of the coin within said pocket.

4. Apparatus, as claimed in claim 2 wherein said circuitry is coupled to said diverter means to selectively activate said diverter means depending on whether said pocket contains a coin of a type included in the at least one acceptable type.

5. Apparatus, as claimed in claim 4, further comprising an acceptance bin wherein said circuitry is coupled to said diverter means to activate said diverter when said pocket contains a coin of a type included in the at least one acceptable type, to divert said coin to said acceptable bin, wherein said coin substantially free falls from a contact with said lever.

6. Apparatus, as claimed in claim 2, further comprising a customer-return chute and wherein, when said diverter means does not remove a contents of said pocket, the contents of said pocket is delivered to said customer-return chute, wherein the contents substantially free falls from said pocket.

7. Apparatus as claimed in claim 1 further comprising a rotation sensor for measuring a rate of rotation of said disk.

8. Apparatus as claimed in claim 1 further comprising a rotation sensor for measuring a rate of rotation rate of said disk.

9. Apparatus as claimed in claim 1 wherein said axis of rotation is inclined to horizontal less than about 45 degrees.

10. Apparatus as claimed in claim 1, further comprising an electric motor coupled for rotating said disk, wherein said motor is oscillated when current to said motor increases over a predetermined threshold.

11. Apparatus as claimed in claim 1 wherein a plurality of coin pockets are formed in said disk.

12. Apparatus as claimed in claim 1 further comprising a wear-resistance coating on at least a portion of said disk.

13. Apparatus, as claimed in claim 1, wherein when said output is not indicative of the coin, said free end is displaced from said groove, and does not cam an object from said coin pocket.

14. Apparatus for coin discrimination comprising:

a disk rotatable about a rotation axis, said disk having pocket means sized and shaped to accommodate a range of coin sizes, including coins of at least a first acceptable coin type;

means for sensing at least a first physical characteristic of a coin, said means for sensing positioned so that, during rotation of said disk, said pocket means will move past said means for sensing, said means for sensing including a generally U-shaped magnetic core capable of providing signals indicative of a change in inductance and conductivity at a plurality of frequencies;

means, coupled to said means for sensing, for discriminating a coin of said first acceptable type from another object capable of residing in said pocket means; and means for lifting said discriminated coin of said first acceptable type from said pocket means; and a plurality of protrusions on a surface of said pocket means for reducing frictional resistance to sliding of a coin within said pocket means.

15. Apparatus, as claimed in claim 14, further comprising means for dislodging coins not residing in said pocket means.

16. Apparatus, as claimed in claim 14, further comprising means for sensing jamming of said disk.

17. Apparatus, as claimed in claim 16, further comprising means for oscillating said disk in response to said means for sensing jamming.

18. Apparatus, as claimed in claim 14, further comprising reversing rotation of said disk when said means for sensing senses absence of coins in said pocket means for at least a predetermined period.

19. Apparatus, as claimed in claim 14, further comprising a bowl for receiving a plurality of randomly oriented coins, said bowl having an exit opening adjacent said disk.

20. Apparatus, as claimed in claim 19, where said bowl includes means for urging coins to an attitude parallel to said disk.

21. Apparatus, as claimed in claim 14, further comprising means for indicating the rotational position of said disk.

22. Apparatus, as claimed in claim 21 wherein said means for indicating includes an optical detector for outputting pulses corresponding to each of said pocket means.

23. Apparatus for coin discrimination comprising:

a bowl for receiving a plurality of randomly oriented coins, said bowl having at least one exit opening;

a disk rotatable about a rotation axis, said rotation axis being inclined to horizontal about fifteen degrees, said disk mounted adjacent said exit opening wherein said bowl includes means for urging coins to an attitude parallel to said disk, said disk having a plurality of recesses formed therein, sized and shaped to accommodate at least one coin denomination, to define coin pockets in said disk, each said coin pocket having a floor region, wherein a plurality of protrusions are positioned on each said floor region;

first and second resilient fingers adjacent said disk configured to dislodge coins not seated in said coin pockets;

a sensor configured to output signals indicative of conductivity and diameter of a coin, said sensor positioned so that, during rotation of said disk, said pockets will move past said sensor;

circuitry coupled to said sensor configured to discriminate said at least one coin denomination in response to said signals;

an electric motor coupled for rotating said disk, wherein said motor is oscillated when current to said motor increases over a predetermined threshold and said motor is reversed when said sensor senses absence of coins in said pockets for at least a predetermined period;

an acceptance bin;

a customer-return chute;

an optical detector for outputting pulses corresponding to each of said pockets; and an activatable ramp which is controllably movable from a first position with said ramp above said pockets, to a second position with at least a portion of said ramp within at least one of said pockets, said ramp positioned so that, during rotation of said disk, said pockets will move past said activatable ramp, wherein said circuitry is coupled to said ramp to activate said ramp a predetermined period after said pulse corresponding to said one of said pockets when said one of said pockets contains a coin of said one denomination, to divert said coin to said acceptance bin and wherein, when said ramp is not activated, contents of said one of said pockets are delivered to said customer-return chute.

24. Apparatus for coin discrimination comprising:

a container for receiving a plurality of randomly oriented coins, said container having at least one exit opening;

a disk rotatable about a rotation axis and mounted adjacent said exit opening, said disk having at least a first recess formed therein, sized and shaped to accommodate at least one acceptable coin type, to define a coin pocket in said disk;

a plurality of protrusions on a surface of said pocket;

a sensor configured to output a first signal indicative of at least a first physical characteristic of a coin, said sensor positioned so that, during rotation of said disk, said pocket will move past said sensor;

circuitry coupled to said sensor configured to discriminate said at least one coin denomination in response to said first signal.

25. Apparatus, as claimed in claim 24, wherein said protrusions are substantially elongated, and each such protrusion defines an angle with respect to a radius of said disk which passes through a centroid of said protrusion, said angle being between about 40° and about 50°.

26. Apparatus for coin discrimination comprising:

a disk rotatable about a rotation axis, said disk having pocket means sized and shaped to accommodate a range of coin sizes, including coins of at least a first acceptable coin type;

means for sensing at least a first physical characteristic of a coin, said means for sensing positioned so that, during rotation of said disk, said pocket means will move past said means for sensing, said means for sensing including a generally U-shaped magnetic core capable of providing signals indicative of a change in inductance and conductivity at a plurality of frequencies;

means, coupled to said means for sensing, for discriminating a coin of said first acceptable type from another object capable of residing in said pocket means; and means for lifting said discriminated coin of said first acceptable type from said pocket means; and wherein said pocket means traverses an interior between legs of said U-shaped core.

* * * * *

UNITED STATES PATENT AND TRADEMARK OFFICE

CERTIFICATE OF CORRECTION

PATENT NO. : 6,168,001
DATED : January 2,2001
INVENTOR(S) : Davis

It is certified that error appears in the above-identified patent and that said Letters Patent is hereby corrected as shown below:

Claim 7, column 17, lines 26-27 should be deleted and the following inserted therefor:

-- 7. Apparatus as claimed in claim 1 wherein said protrusions are substantially elongated to define an angle with respect to the radius of said disk which passes through a centroid of said protrusion.--

Signed and Sealed this

Fifth Day of June, 2001

Nicholas P. Godici

NICHOLAS P. GODICI

*Acting Director of the United States Patent and Trademark Office*

*Attest:*

*Attesting Officer*